US009900700B2

(12) United States Patent
Casset et al.

(10) Patent No.: US 9,900,700 B2
(45) Date of Patent: Feb. 20, 2018

(54) DIGITAL ACOUSTIC DEVICE WITH INCREASED SOUND POWER

(71) Applicant: COMMISSARIAT A L'ENERGIE ATOMIQUE ET AUX ENERGIES ALTERNATIVES, Paris (FR)

(72) Inventors: Fabrice Casset, Tencin (FR); Remy Dejaeger, Eveux (FR); Stephane Fanget, Le Grand Lemps (FR); David Henry, Gieres (FR); Quentin Leclere, Satolas et Bonce (FR)

(73) Assignee: Commissariat à l'énergie atomique et aux énergies alternatives, Paris (FR)

( * ) Notice: Subject to any disclaimer, the term of this patent is extended or adjusted under 35 U.S.C. 154(b) by 0 days.

(21) Appl. No.: 14/915,749

(22) PCT Filed: Sep. 4, 2014

(86) PCT No.: PCT/EP2014/068833
§ 371 (c)(1),
(2) Date: Mar. 1, 2016

(87) PCT Pub. No.: WO2015/032855
PCT Pub. Date: Mar. 12, 2015

(65) Prior Publication Data

US 2016/0205478 A1 Jul. 14, 2016

(30) Foreign Application Priority Data

Sep. 4, 2013 (FR) ..... 13 58462

(51) Int. Cl.
*H04R 17/02* (2006.01)
*H04R 7/26* (2006.01)
(Continued)

(52) U.S. Cl.
CPC ..... *H04R 7/26* (2013.01); *H04R 31/00* (2013.01); *H04R 1/005* (2013.01); *H04R 17/00* (2013.01);
(Continued)

(58) Field of Classification Search
CPC . H04R 17/02; H04R 2217/00–2217/03; H04R 7/04
(Continued)

(56) References Cited

U.S. PATENT DOCUMENTS 4,297,537 A * 10/1981 Babb ..... H04R 1/023 381/189
4,399,334 A 8/1983 Kakiuchi et al.
(Continued)

FOREIGN PATENT DOCUMENTS

FR 2 481 039 A1 10/1981
WO 2007/135680 A1 11/2007
WO 2011/111042 A1 9/2011

OTHER PUBLICATIONS

International Search Report dated Dec. 16, 2014, in PCT/EP2014/068833, filed Sep. 4, 2014.
(Continued)

*Primary Examiner* — Suhan Ni
(74) *Attorney, Agent, or Firm* — Oblon, McClelland, Maier & Neustadt, L.L.P.

(57) ABSTRACT

A digital acoustic device including: at least one suspended diaphragm facing a support and at least one actuator associated with the diaphragm, the associated actuator being configured to move the diaphragm away from and/or closer to the support; a stop mechanism configured to interrupt movement of the diaphragm further to activating the actuator when the diaphragm has a non-zero speed, the stop mechanism being sized to interrupt the movement of the
(Continued)

diaphragm when the movement of the diaphragm is greater than or equal to 50% of the theoretical maximum stroke of the diaphragm and lower than or equal to 95% of the theoretical maximum stroke of the diaphragm.

21 Claims, 12 Drawing Sheets

(51) Int. Cl.
*H04R 31/00* (2006.01)
*H04R 1/00* (2006.01)
*H04R 17/00* (2006.01)

(52) U.S. Cl.
CPC .. *H04R 2201/003* (2013.01); *H04R 2307/201* (2013.01); *H04R 2307/207* (2013.01)

(58) Field of Classification Search
USPC ..... 381/173, 190, 431
See application file for complete search history.

(56) References Cited

U.S. PATENT DOCUMENTS 5,347,587 A * 9/1994 Takahashi ..... H03F 3/2175 381/111
5,394,479 A * 2/1995 Ishigaya ..... G10K 9/13 381/394
9,014,412 B2 * 4/2015 Humphreys ..... H04R 9/04 381/396
2001/0033670 A1 10/2001 Tai et al.
2005/0082946 A1 * 4/2005 Takeuchi ..... B81B 3/0018 310/328
2008/0037814 A1 * 2/2008 Shau ..... H04R 1/22 381/337
2009/0154734 A1 6/2009 Jeong et al.
2011/0051985 A1 3/2011 Hwang et al.
2011/0064250 A1 3/2011 Jeong et al.
2011/0075867 A1 3/2011 Chung et al.
2011/0150381 A1 6/2011 Matsumoto et al.
2012/0148071 A1 6/2012 Dehe
2012/0306290 A1 12/2012 Fanget
2013/0089224 A1 4/2013 Dehe et al.
2013/0294636 A1 11/2013 Cassett et al.
2014/0177881 A1 6/2014 Fanget et al.
2014/0286770 A1 9/2014 Henry
2014/0360255 A1 12/2014 Javelot et al.

OTHER PUBLICATIONS

French Search Report dated Jul. 7, 2014, in FR 13 58462 filed Sep. 4, 2013.
Office Action dated Apr. 6, 2017 in European Patent Application No. 14 766 933.7.
Ryota Saito et al., "A Digitally Direct Driven Dynamic-type Loudspeaker". Audio Engineering Society Convention Paper 7344, May 2008, pp. 1-8.
U.S. Appl. No. 14/939,283, filed Nov. 12, 2005, Nicolas, et al.

* cited by examiner

DIGITAL ACOUSTIC DEVICE WITH INCREASED SOUND POWER

TECHNICAL FIELD AND PRIOR ART

The present invention relates to a digital acoustic device with increased sound power, for example a digital loudspeaker or a photoacoustic imaging device.

Loudspeakers can be found in a large number of equipments such as mobile phones, flat screens, etc. and the miniaturization thereof is desired. MEMS technologies make it possible to have ultrafine loudspeakers.

MEMS technology is particularly suited to create digital loudspeakers, for which the large diaphragm of the analog loudspeaker is replaced by several unit diaphragms or more, generally by several small sized ultrafine acoustic transducers, referred to as speaklets, enabling the sound to be reconstituted.

In the case of the digital loudspeaker, each speaklet is individually actuated according to the sound to be reconstructed, in a high position or a low position.

Nevertheless, the digital loudspeakers provide a low sound level.

Solutions have been provided to increase the sound pressure of a microphone. For example, US 2011/0075867 describes a microphone comprising a diaphragm fitted in its centre with a mass, the effect of which is to reduce the resonance frequency of the diaphragm and thus to increase the sound pressure. US 2011/0051985 describes a digital microphone comprising a diaphragm fitted with a piston fixed to the diaphragm.

DISCLOSURE OF THE INVENTION

As a result, a purpose of the invention is to provide a digital acoustic device, for example a loudspeaker with an increased sound power.

The above stated purpose is reached by a digital acoustic device comprising at least one suspended diaphragm, at least one actuator associated with said diaphragm to move it upwards or downwards, and means interrupting the movement of the diaphragm further to activating the actuator associated with the diaphragm. Interrupting means are sized so that the movement of the diaphragm is interrupted when it has a non-zero speed.

Preferably, the speed at which the upward or downward movement, due to the use of the associated actuator is stopped, is the maximum or substantially maximum speed that the diaphragm can have. The greater the deceleration of the diaphragm, the greater the sound pressure generated by the movement of the diaphragm.

In other words, in the digital acoustic device according to the invention, the movement of the diaphragm is deliberately interrupted, preferably when it has a high speed, or even a maximum speed to obtain a sharp deceleration of the diaphragm and thus generate a high sound pressure. These stop members are therefore sized to interrupt the movement of the diaphragm before it reaches the end of its stroke.

Advantageously, the means for stopping the diaphragm during its movement are carried by a substrate facing the diaphragm. They form an element or elements protruding from the substrate towards the diaphragm and are sized to contact the diaphragm when it has a non-zero speed, preferably a high speed and more preferably a maximum speed. Preferably, the distance between the free end of the stop member(s) and the diaphragm at rest is between 50% and 75% of the theoretical maximal stroke of the diaphragm.

Alternatively, the means for stopping the diaphragm during its movement are carried by the diaphragm, they form a protruding element or protruding elements and are sized to contact the substrate facing the diaphragm when it has a non-zero speed, preferably a high speed and more preferably a maximum speed. Preferably, the distance between the free end of the stop member(s) and the support when the diaphragm is at rest is between 50% and 75% of the theoretical maximal stroke of the diaphragm.

The digital acoustic device can be a digital loudspeaker or a photoacoustic imaging system.

The subject-matter of the present invention is therefore a digital acoustic device comprising at least one suspended diaphragm facing a support and at least one actuator associated with said diaphragm, said associated actuator being intended to move said diaphragm away from and/or closer to said support, said device also comprising stop means intended to interrupt the movement of said diaphragm further to activating said actuator when the diaphragm has a non-zero speed, the stop means being sized so as to interrupt the movement of the diaphragm when the movement of the diaphragm is greater than or equal to 50% of the theoretical maximum stroke of the diaphragm and lower than or equal to 75% of the theoretical maximum stroke of the diaphragm.

Preferably, the stop means are sized so as to interrupt the movement of the diaphragm when the movement of the diaphragm is between 50% and 60% of the theoretical maximum stroke of the diaphragm.

Advantageously, the stop means are sized so as to interrupt the movement of the diaphragm when it moves at its maximum speed or at a speed closer to its maximum speed, i.e. at a speed greater than or equal to 75% of its maximum speed.

The stop means can comprise at least one stop member protruding from the support towards the diaphragm and/or protruding from the diaphragm towards the support, and having a free end separated by a non-zero distance from the diaphragm and/or the support at rest, respectively.

The stop member can be located facing a central area of the diaphragm or can be fixed in a central area of the diaphragm.

Advantageously, the distance separating the free end from the stop member and the diaphragm or the free end from the stop member and the support is between 50% and 75% of the theoretical maximum stroke of the diaphragm.

Advantageously, the digital acoustic device comprises a plurality of stop members.

Preferably, the stop members are distributed on an area corresponding to a surface representing between 10% and 50% of the diaphragm surface.

In an exemplary embodiment, the digital acoustic device comprises a gaseous fluid between the diaphragm and the support, the device comprising at least one passageway in the support for the flow of the gaseous fluid so as to reduce the viscous damping. The passageway can be formed between two stop members.

For example, the stop member(s) are in the shape of a column with a circular, square, ellipsoidal or trapezoidal cross-section.

The stop member(s) can be integral with the support and/or the diaphragm.

According to a further feature, the stop member(s) are formed by one or more layers of materials applied on the substrate and/or the diaphragm.

The actuator can be carried by the diaphragm and is facing the free end of the stop member, said device comprising a protective layer deposited on the actuator so as to protect it from the contact with the free end of the stop member.

At least one actuator can be formed by a piezoelectric actuator.

The digital acoustic device can comprise a first actuator in contact with the diaphragm intended to exert a strain on the diaphragm along a first direction, a second actuator in contact with the diaphragm intended to exert a strain on the diaphragm along a second direction opposite to the first.

The first and second actuators can comprise a ferroelectric piezoelectric material, each of the first and second actuators being intended to deform the diaphragm in an opposite direction.

In an exemplary embodiment, the first actuator bounds the outer periphery of the diaphragm and the second actuator is substantially located in a central area of the diaphragm.

The digital acoustic device can comprise a second support facing the diaphragm opposite to the first support, said second support comprising stop means intended to interrupt the movement of said diaphragm further to activating said second actuator.

Preferably, the digital acoustic device comprises a plurality of diaphragms and actuators associated with each of the diaphragms.

Another subject-matter of the present invention is also a method for creating a digital acoustic device according the invention, a) creating the diaphragm and the actuator,
b) creating the stop means on the support and/or on the diaphragm,
c) assembling the diaphragm and the actuator with the support so that the stop means are facing the diaphragm and/or the support respectively, at a given distance when the diaphragm is at rest.

The stop member can also advantageously be created simultaneously to at least one electric connection of the actuator, between the support and the actuator.

In an exemplary embodiment, prior to creating the stop member and the electric connection, an electric line can be created, the electric connection being formed on said electric line, so that the height of the electric line connection assembly is greater than the one of the stop member.

In another exemplary embodiment, prior to creating the stop member, a recess can be created in an area of the support where the stop member is formed so that the height of the support and electric connection assembly is greater than the one of the support and stop member assembly.

The stop member is for example created in said substrate and/or the diaphragm by etching.

For example, assembling the support to the diaphragm is made by thermocompression and/or gluing, for example by molecular gluing.

Steps a) and b) are advantageously carried out by microelectronic techniques.

BRIEF DESCRIPTION OF THE DRAWINGS

The present invention will be better understood using the following description and the accompanying drawings in which.

DETAILED DISCLOSURE OF PARTICULAR EMBODIMENTS

In the following description, the invention will be described while considering a digital loudspeaker but it will be understood that the invention also relates to a photoacoustic imaging system, and more generally to a digital acoustic device.

A digital loudspeaker comprises a plurality of acoustic transducers or individually controlled speaklets. The sound to be reproduced is reconstructed by the principle of additivity of the elementary sounds of the speaklets in air. In the following description, an elementary loudspeaker comprising one speaklet will be considered.

Figure 1B:
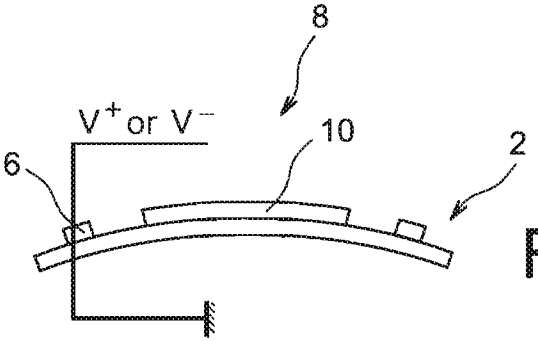
FIGS. 1B and 1C are side views of the diaphragm of FIG. 1A in two different states.
Figure 1C:
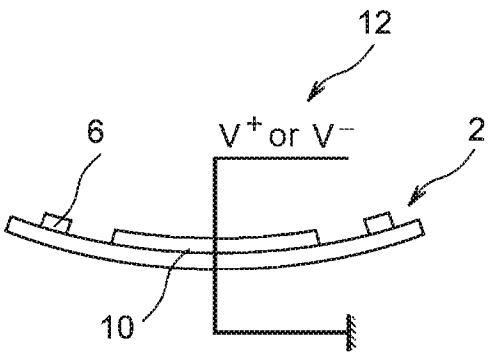
Figure 1A:
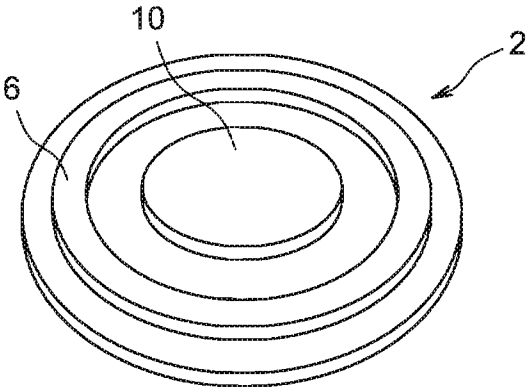
FIG. 1A is a top view of an exemplary diaphragm fitted with an actuator for a digital loudspeaker of the invention.
Figure 2:
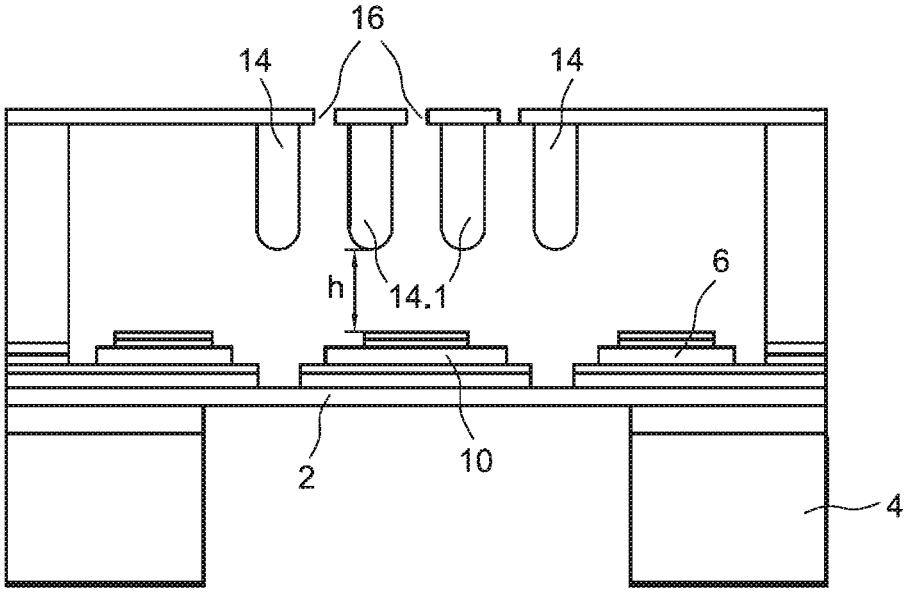
FIG. 2 is a side view of an exemplary embodiment of the loudspeaker according to the invention.

In FIGS. 1A to 1C and 2, a particularly advantageous exemplary elementary loudspeaker with a piezoelectric actuation can be seen. In FIGS. 1A to 1C, only the diaphragm is represented with the actuators. In FIG. 2, the digital loudspeaker comprising a disk-shaped diaphragm 2 is suspended on a support 4, a ring-shaped member of a piezoelectric material 6 located on an upper face of the diaphragm 2 and on the outer edge of the diaphragm 2 can be seen.

The outer periphery of the ring 6 is on the support 4 and the inner periphery is on the diaphragm 2. The ring is connected to a voltage or current source 8 as schematized in FIGS. 1C and 18 so as to form a first actuator able to set in motion the diaphragm 2. To do so, an electrode is provided on the upper face and the lower face of the ring 6 to ensure its connection to the voltage source 8.

In the example shown, the diaphragm device advantageously also comprises a second member of a piezoelectric material 10 as a disk in the example shown, and located in a central part of the upper face of the diaphragm 2. The disk 10 is also connected to a voltage or current source 12 as schematized in FIGS. 1C and 18 so as to form a second actuator able to set in motion the diaphragm 2. An electrode is provided on each face of the ring to ensure its connection to the voltage source 8.

In another alternative, the diaphragm can have a square or rectangular shape, in this case the actuator can have a shape similar to the one of the diaphragm but with a different surface.

It is to be noted that the second actuator does not have any part of its surface anchored to the support part.

The first and second actuators can be made with the same piezoelectric materials or with different piezoelectric materials.

In an exemplary embodiment, the actuators are made from ferroelectric piezoelectric materials such as PZT. The movements of the diaphragm obtained thanks to these actuators are those represented in FIGS. 1B and 1C.

Indeed, whatever the sign of the applied voltage, if the latter is greater in absolute value than the coercive field of the ferroelectric piezoelectric material, then the latter material expands in thickness and radially contracts. Consequently, upward or downward movements of the diaphragm are caused by the shape and the position of the actuator on the diaphragm and not by the sign of the control voltage.

In the example shown, the application of a voltage on the first actuator 6 causes an upward movement of the diaphragm 2, it then has a convex shape relative to the support 4. The application of a voltage on the second actuator 10 causes a downward movement of the diaphragm 2 which then has a concave shape relative to the support 4.

In another exemplary embodiment, the actuators are made from piezoelectric materials such as, for example, AlN, ZnO, etc. A positive voltage causes the expansion of the piezoelectric material whereas a negative voltage will induce its contraction. Thus, upward and downward movements can be obtained using a single actuator.

The amplitude of the movement of the diaphragm is proportional to the voltage applied to the terminals of the actuators.

The advantage of implementing two actuators is to be able to move the diaphragm upwards or downwards, which enables a loudspeaker providing a fine sound reproduction to be more easily made.

However, a loudspeaker comprising a single actuator does not depart from the scope of the present invention. Besides, the digital acoustic device according to the invention can comprise actuator types other than piezoelectric actuators, they can be electrostatic, magnetic, thermal etc. actuators, which are well-known of those skilled in the art.

According to an exemplary embodiment, and as can be more particularly seen in FIG. 2, protruding members are provided on a substrate facing the diaphragm and towards the diaphragm so as to form movement stop members of the diaphragm when it moves at a non-zero speed. The height of the stop members 14 is chosen so that their free end 14.1 contacts the substrate while the diaphragm has a non-zero speed. The distance between the diaphragm at rest and the free end 14.1 of the stop members is referred to as h. Preferably, the height of the stop members is such that the free end of the stop members contacts the diaphragm while the diaphragm has its maximum or substantially maximum speed. Alternatively, the protruding members can be located under the diaphragm in the view of FIG. 2.

Advantageously, the distance h is between 50% and 75% of the theoretical maximum stroke of the diaphragm.

Preferentially, the height of the stop members depends on the deformation of the diaphragm.

In the case of stop members all having the same height, the stop members located closest to the centre of the diaphragm will contact the facing diaphragm first. Due to the inertia produced by its movement, the diaphragm will continue to deform during a short time, and the more peripheral stops will then in turn come in contact.

Preferably, the stop members are located facing a central area of the diaphragm having the greatest deformation, it is also the area having the highest speed. The central part has for example half the diameter of the diaphragm. The stop members are distributed on part of the diaphragm surface so as not to risk damaging, or even breaking the diaphragm.

The distance between the free end of at least one stop member 14 and the diaphragm at rest in then lower than the theoretical maximum stroke of the diaphragm, so as to ensure a contact between the free end 14.1 of the stop member and the diaphragm before it has a zero speed.

Placing the stop members facing this area enables a more significant deceleration and therefore the generation of a high sound pressure to be caused.

From single stop member 14 up to several tens or even several hundreds stop members can be provided.

Preferably, the stop member(s) are distributed on an area having a surface corresponding to between 10% and 50% of the diaphragm surface.

The stop members can have any shape, for example a cylindrical shape with a circular, ellipsoidal cross-section, a shape of a straight block, etc.

The cross-section of the stop members is determined as a function of the number of stop members, and/or of the diaphragm surface and/or the diaphragm rigidity. The cross-section of the stop members can for example be comprised between a few tens of $\mu m^2$ and a few $mm^2$.

The distance between the stop members is also chosen as a function of the diaphragm surface and/or the diaphragm rigidity. For example, the more flexible the diaphragm, the closer the stop members to each other in order to limit, or even avoid the parasitic deformations of the diaphragm. This distance is preferably between a few tens of μm and a few mm, this distance further enabling a gaseous damping which can be induced by the presence of these stop members to be reduced.

Advantageously, at least one passageway 16 is provided in the substrate facing the diaphragm in the substrate in order to limit the occurrence of a viscous damping when the diaphragm gets closer to the stop members, this passageway enabling air or any other gaseous fluid to flow and the movement of the diaphragm to be hardly or not dampened. In the example shown, passageways 16 are created between the stop members.

Advantageously, a protective layer is formed at least on the central actuator 10 so that the contact between the stop members and the actuator does not damage it.

In other actuator embodiments, the stop members are preferably provided relative to the actuator(s) so as not to contact the actuator. For example, in the configuration of the actuators 6 and 10 of FIG. 1, the stop members are disposed between the actuators 10 and 6. Considering a diaphragm having a small surface, disposing the stop members only on a rim is sufficient to stop the diaphragm and not induce a too great deformation of the centre thereof.

The distance between the rest position of the diaphragm and the free end 14.1 of the stop member is determined as a function of the dimension of the diaphragm and of the materials forming it, in particular the mechanical properties thereof, especially defined by the Young modulus, the density and the Poisson coefficient, these parameters setting the maximum stroke of the diaphragm.

In order to determine the maximum stroke of the diaphragm, the movement of the diaphragm is calculated. The latter can be calculated by finite element calculation softwares such as the ANSYS, COVENTOR, etc. softwares, or analytically as in the following equation giving the dynamic movement of the diaphragm:

$$w = \frac{-4P_3V(\lambda_1 r^4 - \lambda_2 b^2 r^2 + \lambda_3 b^4)\int_0^b H_5(r)r\,dr}{M_1},$$

-continued with:

$$p_3 = \frac{\pi g_{31} E_1 V(3t_1 - 2t_3)}{(1-\mu_1)\overline{\beta_{33}}}$$

$$E_1 = \frac{1}{S_{11}^D},\ \mu_1 = -\frac{S_{12}^D}{S_{11}^D},\ \overline{\beta_{33}} = \beta_{33} + \frac{2g_{31}^2 E_1}{1-\mu_1}$$

$$\lambda_1 = 1+\mu_1,\ \lambda_2 = 6+2\mu_1,\ \lambda_3 = 5+\mu_1$$

$$M_1 = 8P_1\int_0^a H_1(r)r\,dr + 8P_2\int_0^b H_2(r)r\,dr + 16P_4\int_0^b H_3(r)r\,dr - \left\{\pi t_2\rho_m\omega^2\int_0^a H_4(r)r\,dr + 2\pi t_1\rho_p\omega^2\int_0^b H_4(r)r\,dr\right\}$$

$$H_1(r) = 20\lambda_1^2 r^4 - 8\lambda_1\lambda_2 b^2 r^2 + \lambda_2^2 b^4 + \mu_2(12\lambda_1^2 r^4 - 8\lambda_1\lambda_2 b^2 r^2 + \lambda_2^2 b^4)$$

$$H_2(r) = 20\lambda_1^2 r^4 - 8\lambda_1\lambda_2 b^2 r^2 + \lambda_2^2 b^4 + \mu_1(12\lambda_1^2 r^4 - 8\lambda_1\lambda_2 b^2 r^2 + \lambda_2^2 b^4)$$

$$H_3(r) = (4\lambda_1 r^2 - \lambda_2 b^2)^2$$

$$H_4(r) = (\lambda_1 r^4 - \lambda_2 b^2 r^2 + \lambda_3 b^4)^2$$

$$H_5(r) = 4\lambda_1 r^2 - \lambda_2 b^2$$

$g_{31}$ is the piezoelectric coefficient which links the electric field applied out-of-plane (direction 3) and the stress in the plane (direction 1), V refers to the applied voltage. $S_{11}^D$ and $S_{12}^D$ are respectively the relative deformations in the plane (directions 1 and 2) obtained in response to a stress applied along the direction 1. The exponent D means "with a constant load". b is the radius of the piezoelectric layer. This equation is for example explained in document Li, "*Theoretical modelling of a circular piezoelectric actuator for micro systems", ICINA* 2010. The distance between the diaphragm at rest and the free end 14.1 of the stop member 14 is later determined.

This distance is chosen sufficient to enable the diaphragm to reach a significant speed, preferably its maximum speed. Preferably, the contact between the diaphragm and the free end of the stop member occurs before the diaphragm decelerates. A distance between the diaphragm at rest and the free end of the stop member will be preferably chosen 50% and 75% of the maximum stroke of the diaphragm, preferably between 50% and 60%.

By way of example, for a diaphragm having a radius of 500 μm for example, the deflection of the diaphragm will be in the order of 3 μm. If h is chosen to be at 50% of the maximum stroke, h will then be 1.5 μm.

Figure 3:
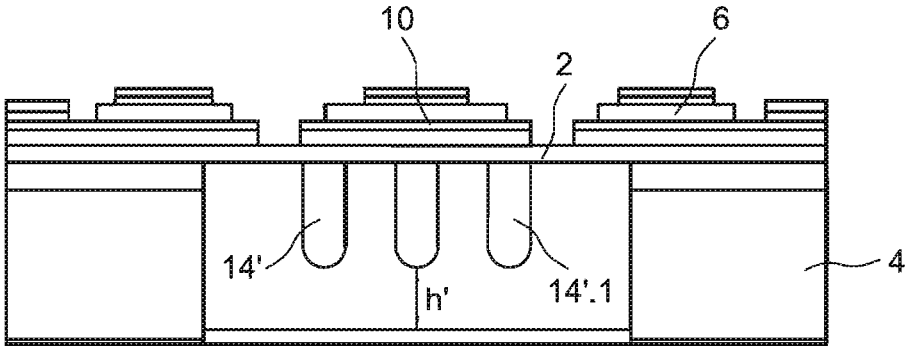
FIG. 3 is a side view of another exemplary embodiment of the loudspeaker according to the invention.

In FIG. 3, another exemplary embodiment can be seen, in which the stop members are carried by the diaphragm. In this case, the distance h' between the free ends 14.1' of the stop members 14' and the substrate when the diaphragm is at rest is preferably set to be between 50% and 75% of the theoretical maximum stroke of the diaphragm.

The features of the stop members carried by the substrate, such as the cross-section, the spacing, etc. described for the stop members 14 also apply to the stop members 14'.

Figure 4:
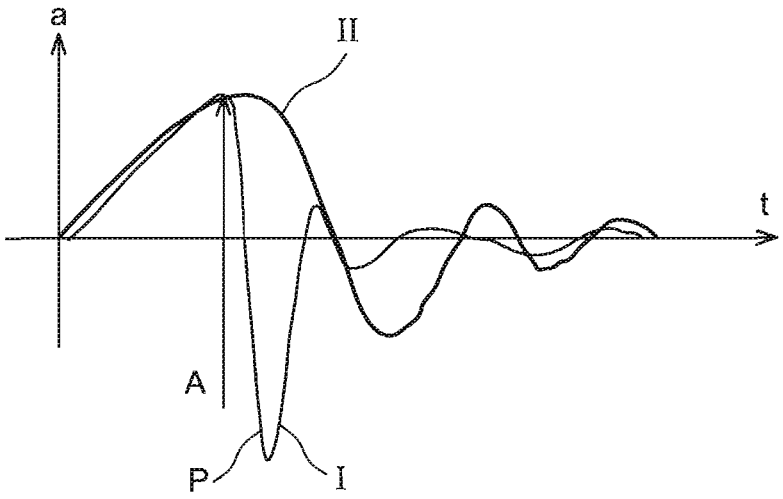
FIG. 4 is a graphic representation of the acceleration of the diaphragm as a function of time t for a state of the art system and a loudspeaker according to the invention.

In FIG. 4, the variation in the acceleration a of the loudspeaker diaphragm of the invention (curve referred to as I) and the variation in the acceleration of a state of the art loudspeaker diaphragm without a stop member (curve referred to as II) as a function of time, are shown.

The surface areas of both curves are identical, but the peak referred to as p due to the deceleration of the diaphragm is sharper than the peak of the curve II and its amplitude is greater than the one of the peak of the curve II during the acceleration, A refers to the contact between the stop member(s) and the diaphragm in the embodiment of FIG. 2.

But the sound pressure caused by a speaklet and thus the capacity of the digital loudspeaker to reconstitute an audible sound of the desired sound level, depend on the speed (acceleration a) of the speaklet diaphragm and of its capacity not to cause parasite, that is its capacity not to have parasitic oscillations.

The sound pressure as a function of the acceleration is written as follows:

$$P(r,t) = \frac{\rho_0 \cdot a^2}{r}\frac{dV(t)}{dt}$$

or $$P(r,t) = \frac{\rho_0 \cdot a^2}{r}Acc(t)$$

or $$P(r,t) = \frac{\rho_0 \cdot S}{\pi \cdot r}Acc(t)$$

with

ρ0: per volume ratio of air a: radius of the mobile member

S: surface of the mobile member r: listening distance

V: speed of the mobile member

Acc: acceleration of the mobile member

If a increases, the sound pressure will increase. The above equation also applies with the deceleration. According to the present invention, the deceleration is increased. By increasing the latter, the sound pressure is also increased.

A particularly advantageous exemplary of a method for manufacturing a loudspeaker of the invention will now be described.

Figure 5A:
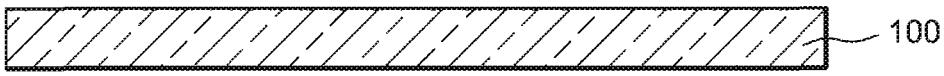
FIGS. 5A to 5R are diagrammatic views of steps for creating a diaphragm and actuators of a loudspeaker according to an exemplary embodiment.
Figure 5B:
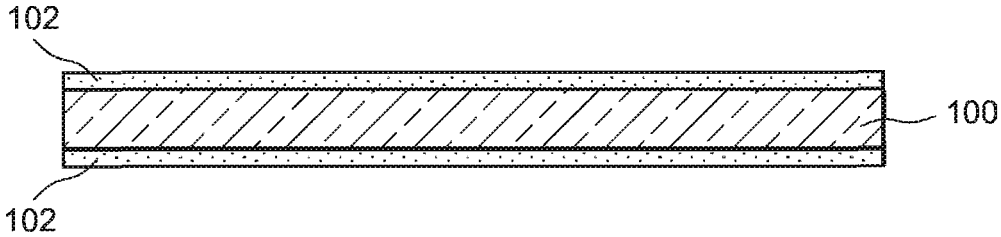
Figure 5C:
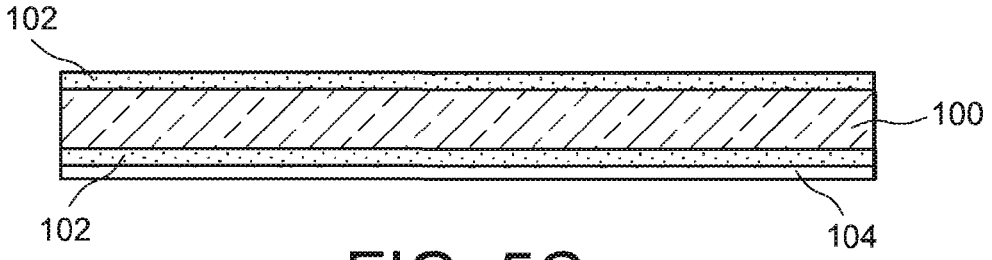
Figure 5D:
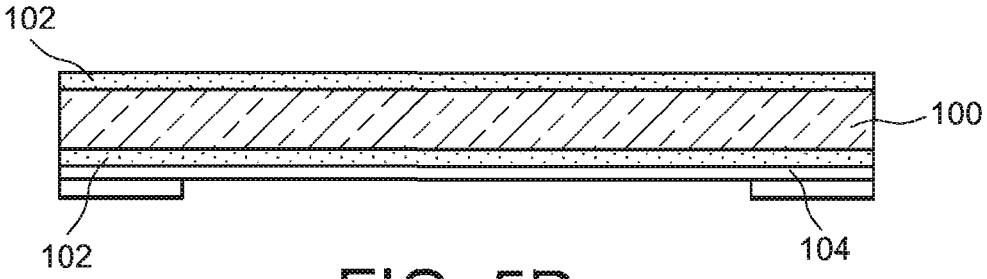
Figure 5E:
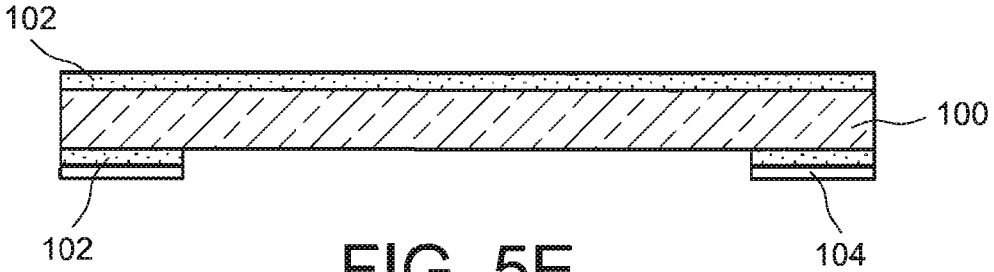
Figure 5F:
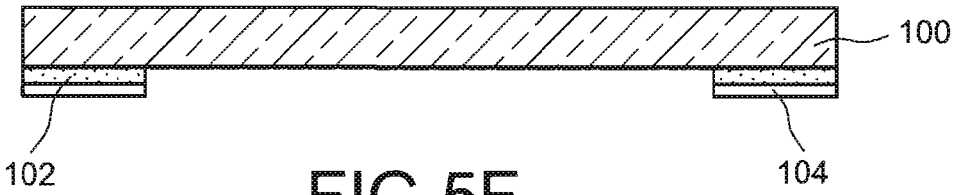
Figure 5G:
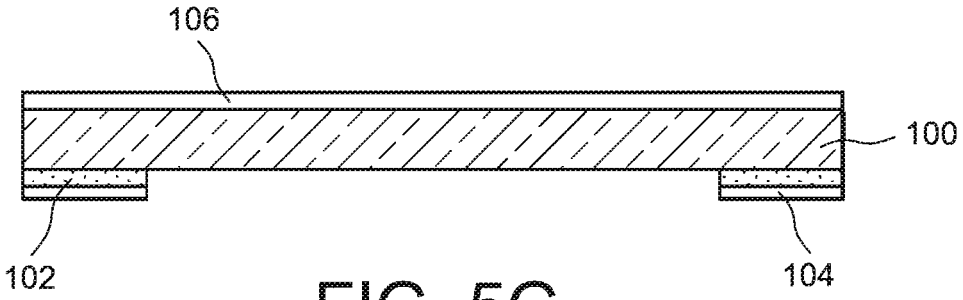
Figure 5H:
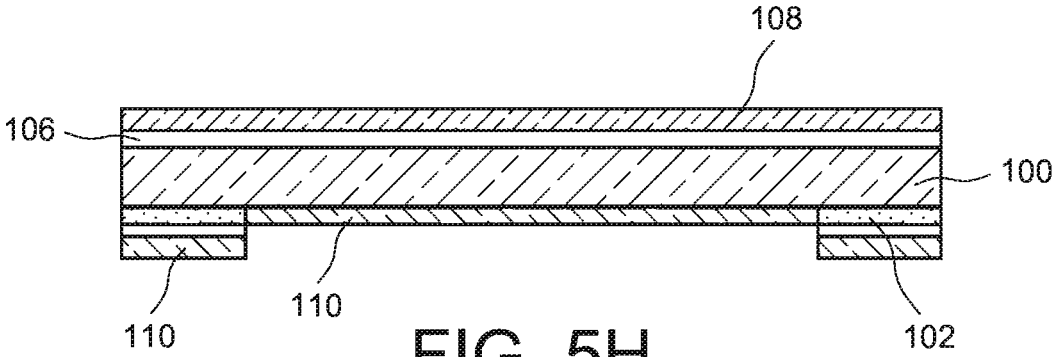
Figure 5I:
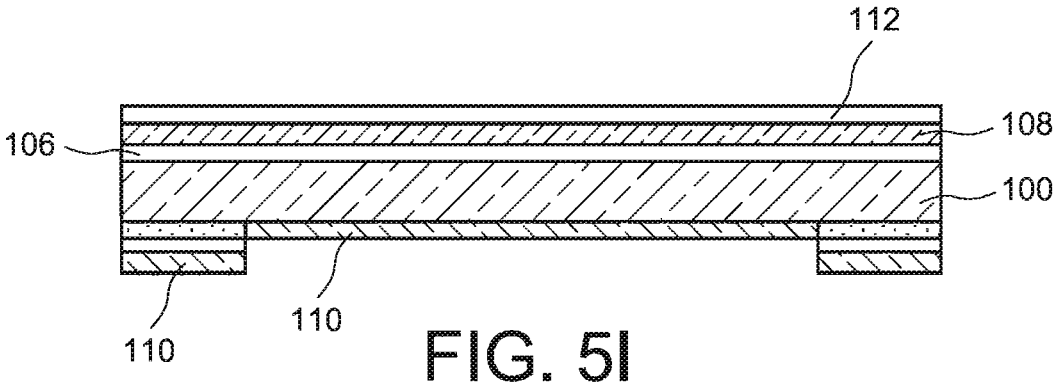
Figure 5J:
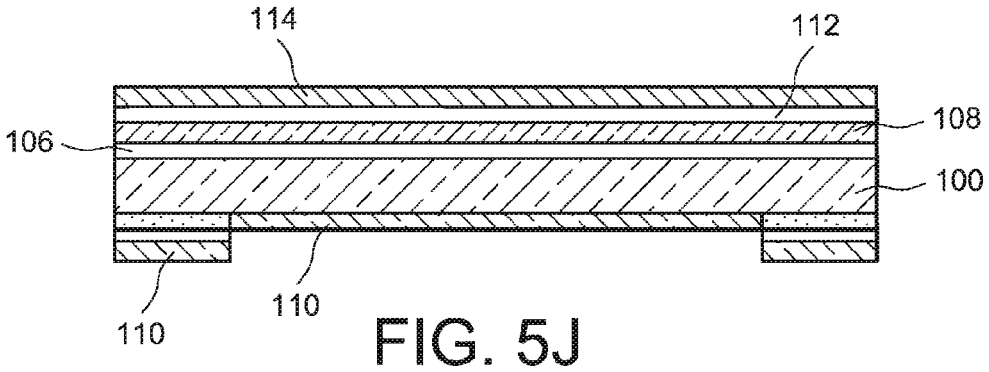
Figure 5K:
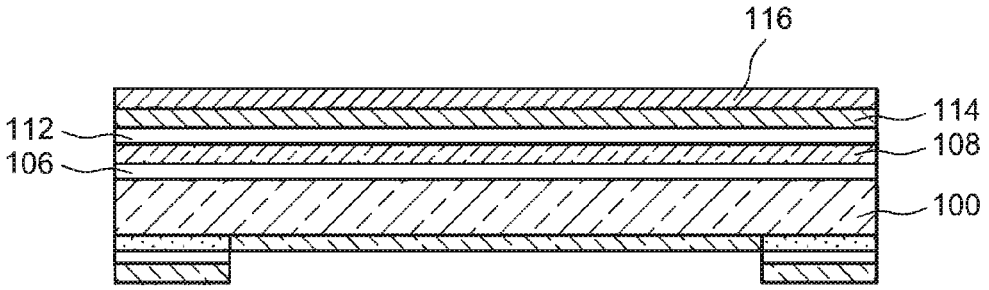
Figure 5L:
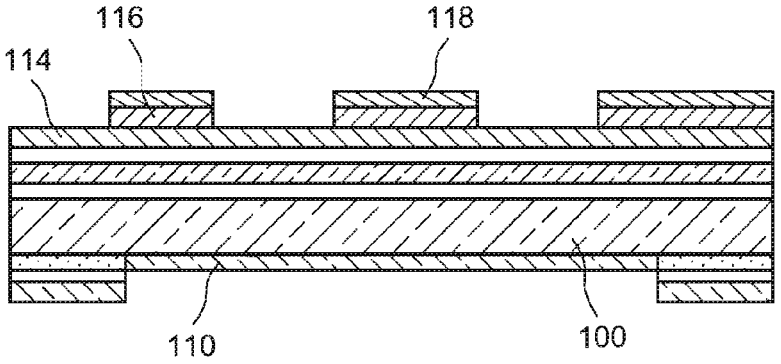
Figure 5M:
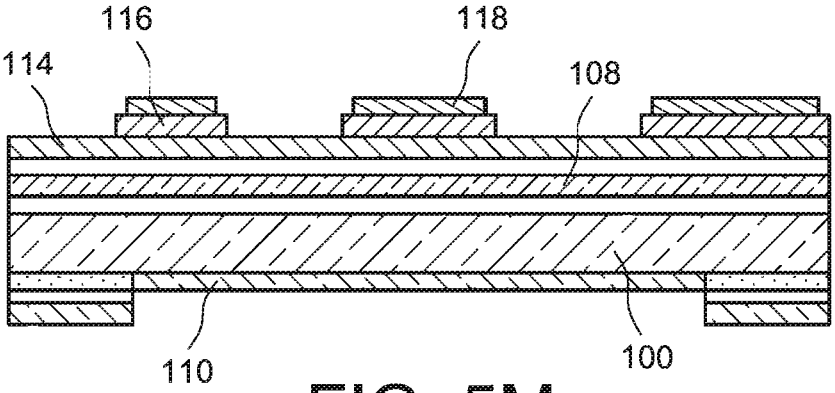
Figure 5N:
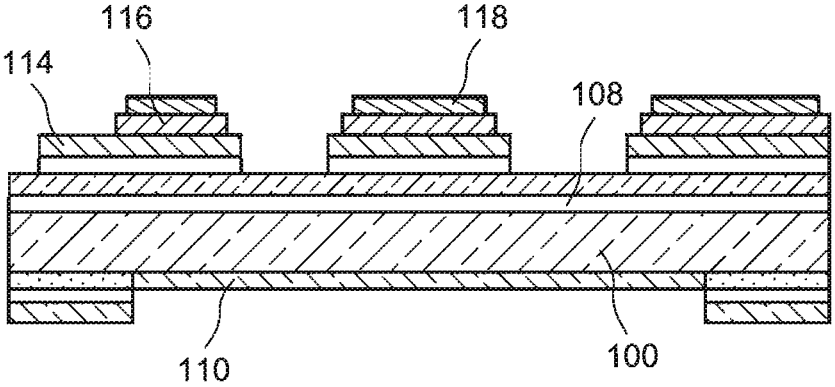
Figure 5O:
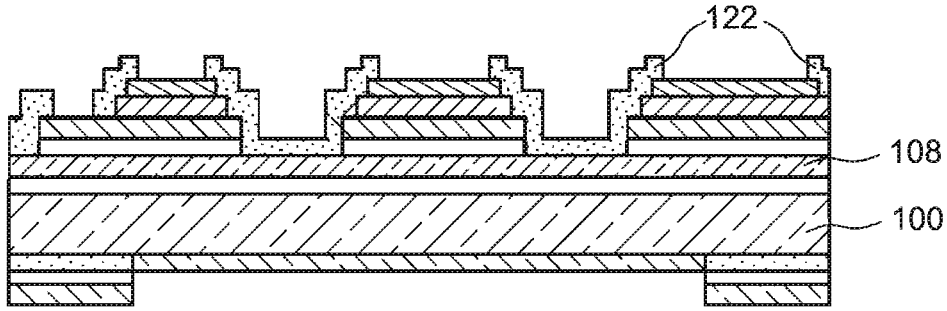
Figure 5P:
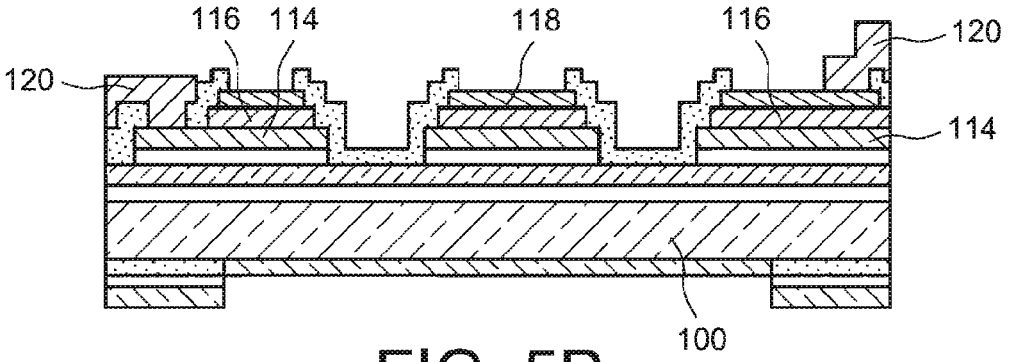
Figure 5Q:
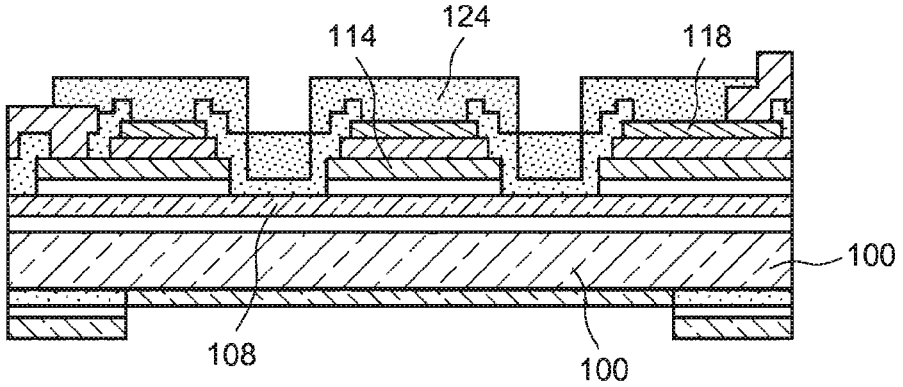
Figure 5R:
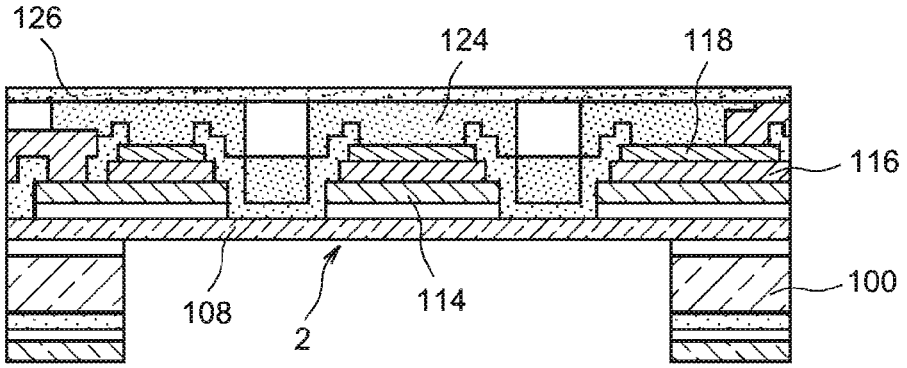

The steps are schematically shown in FIGS. 5A to 5R.

For example, a silicon substrate 100 shown in FIG. 5A is used, having for example a thickness of 725 μm and a diameter of 200 mm.

During a first step, a thermal oxidation of the substrate is carried out so as to form an oxide layer 102 on all the surfaces of the substrate with for example a thickness of 2 μm. The member thus obtained is shown in FIG. 5B.

Then, an oxide hard mask 104 is made on the back face of the substrate. This mask has for example a thickness of 7 μm. The mask is made by turning over the substrate; as a function of the chosen deposition composition, it is possible to deposit the mask only on this face. It can be, for example, PVD (Physical Vapour Deposition). The member thus obtained is shown in FIG. 5C.

Then, a lithography at the back face is carried out so as to reach the silicon. The member thus obtained is shown in FIG. 5D.

During a following step, the hard mask is etched at the back face, for example by a Reactive-Ion Etching (RIE), so as to reach the back face of the substrate 100. The member thus obtained is shown in FIG. 5E.

During a following step, the oxide layer is removed from the front face, for example by stripping or chemical etching. The member thus obtained is shown in FIG. 5F.

During a following step, an oxide layer 106 is formed at the front face. Advantageously, a densification annealing occurs for example at a temperature in the order of 800° C. The member thus obtained is shown in FIG. 5G.

During a following step, a layer 108 is formed at the front face intended to form the diaphragm 2, and a layer 110 is formed at the back face. Preferably, these layers are for example of polysilicon, SiC or $SiO_2$. The thickness of the layers 108, 110 is for example between a few hundreds of nm and several μm, or even several tens of μm.

The layers 108, 110 are for example made by a chemical vapour deposition (CVD) or by epitaxial growth. Preferably, the stresses of the layers 108, 110 are controlled.

The layers 108, 110 can be formed in several steps. For example, for a 4 μm thickness, two 1.5 μm thick layers and one 1 μm thick layer are successively created;

Advantageously, an annealing step then occurs. The member thus obtained is shown in FIG. 5H.

During a following step, a layer 112 is formed on the layer 108, for example of $SiO_2$ or SiN, having for example a thickness between a few hundreds of nm and several μm. The layer 112 is for example formed by thermal oxidation or CVD deposition. Advantageously, a densification annealing occurs for example at a temperature in the order of 800° C.

The member thus obtained is shown in FIG. 5I.

During a following step, the first and second actuators are created.

To do so, a layer 114 intended to form the lower electrodes of the actuators is first made, for example of Pt, Mo. The layer 114 is for example made by deposition on the layer 112. The layer 114 has for example a thickness between a few tens of nm and a few hundreds of nm. The member thus obtained is shown in FIG. 5J.

A layer of piezoelectric material 116 is then formed on the layer 114, in particular of PZT, AlN, ZnO, LNO the thickness of which is for example between a few hundreds nm and several μm.

The upper electrode is then made by forming a layer 118 on the piezoelectric material 116, for example of Ru or Au, for example with a thickness between a few tens of nm and several hundreds of nm. The member thus obtained is shown in FIG. 5K.

Then, the steps of etching occur.

First, the layer 118 is etched so as to delimit the annular actuator 8 and the disk-shaped actuator 10.

Then, the piezoelectric material layer 116 is etched.

The member thus obtained is shown in FIG. 5L.

Then, the remaining portions of the layer 118 are again etched so that they are recessed relative to the portions of the layer 116.

The layer 114 as well as the oxide layer 112 are then etched. The member thus obtained is shown in FIG. 5M.

Preferably, a stepped profile is made. The latter is obtained since all the layers are deposited and then etched, from the upper layer, by using different photolithography masks, the second mask being wider than the first, etc. This makes it possible to leave safety margins to avoid the overlapping of layers which could occur due to the positioning uncertainty of the masks. Any electric short circuit between the electrodes is thus avoided. The member thus obtained is shown in FIG. 5N.

During the following steps, reconnection pads 120 are made. A layer 122 of dielectric material, for example of $SiO_2$, is previously formed on the edges of the stacks formed by the lower and upper electrodes and by the piezoelectric material, this layer being etched so as to partially clear the lower and upper electrodes. The member thus obtained is shown in FIG. 5O.

Then, a layer, for example of AlSi or TiAu, is formed and etched, thus forming contact pads at the areas where the electrodes have been cleared. The member thus obtained is shown in FIG. 5P.

Advantageously, during a following step, a protective layer 124 is formed on the actuators, for example an oxide layer, in order to protect the actuators from the contact with the stop members. The thickness of this layer can be between a few hundreds of nm and a few μm, for example 500 nm.

During a following step, the layer 124 is etched to access the reconnections.

The member thus obtained is shown in FIG. 5Q.

Preferably, during a following step, the actuators are protected, for example by depositing a dry film 126. Then, the back face is etched in order to release the diaphragm 2.

The diaphragm is released by deep etching of the substrate through the back face until the diaphragm is reached.

The member thus obtained is shown in FIG. 5R.

The creation of the stop members will now be described, in this example, the latter are made on an "interposer"-type substrate, i.e. comprising electric connections and/or electronic circuits (control electronic circuits, sensors, etc.). In the example shown, the stop members are very advantageously made simultaneously to the electric connections 18, also referred to as microbumps or copper pillars. The embodiment is thus quicker. The stop members have therefore a structure similar to the one of the electric connections. The electric connections are intended to route the signal from the speaklets to the pads at the periphery of the substrate 200 or to the electronics if it is made on the substrate 20. In the described example, only one stop member is formed, but it will be understood that several stop members can be simultaneously formed.

Figure 6A:
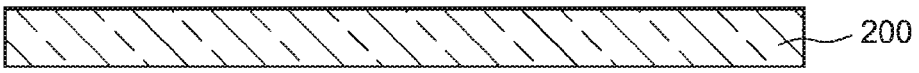
FIGS. 6A to 6D are diagrammatic views of steps for creating a support fitted with stop means of the invention according to an exemplary embodiment.

To do so, let us take for example a silicon substrate 200 (FIG. 6A).

During a first step, lines intended to bring the signal from the speaklet to contact pads (not shown) are made at the periphery of the substrate 200, they are for example copper lines. Then, on one of the faces, a layer, for example of TiCu 202, is formed. Then, by means of a resin, areas intended to form thick copper layers are delimited. The copper layers 204 are then formed for example by growth. Then the resin is removed and the TiCu layer is etched.

Figure 6B:
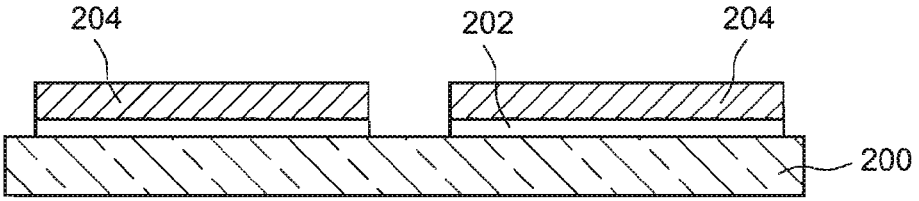

The member thus obtained is shown in FIG. 6B. The copper lines are only present vertically aligned with the contact pads connected to the electrodes. The area of the substrate 200 at least vertically aligned with the central area of the diaphragm does not yet comprise any layer.

During a following step, a TiCu layer 206 is again deposited at the locations where electric connections and stops are desired to be made, and then the Cu growth areas are delimited and the copper portions 208 are made to grow. During this step, microbumps are made on both copper lines and in the area of the substrate 200 in line with the central area of the diaphragm.

SnAg layers 210 are then formed on the three copper 208 and SnAg 210 portions. The resin is removed and the TiCu layer is etched. The portions 208 and 210 have a reduced cross-section relative to the one of the portions 204.

Advantageously, during a following step, passageways 16 can be made in the substrate between the electric connections and the stop member 14 for example by etching; these passageways being intended to reduce the viscous damping as above described.

Figure 6C:
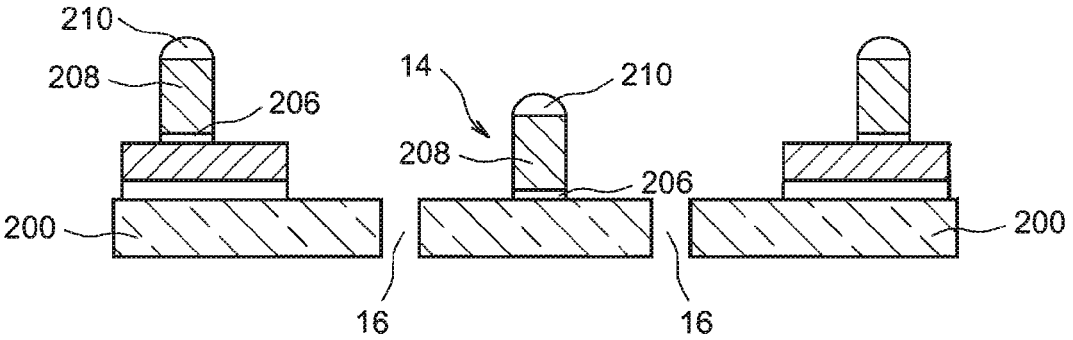

The member thus obtained is shown in FIG. 6C.

Figure 6D:
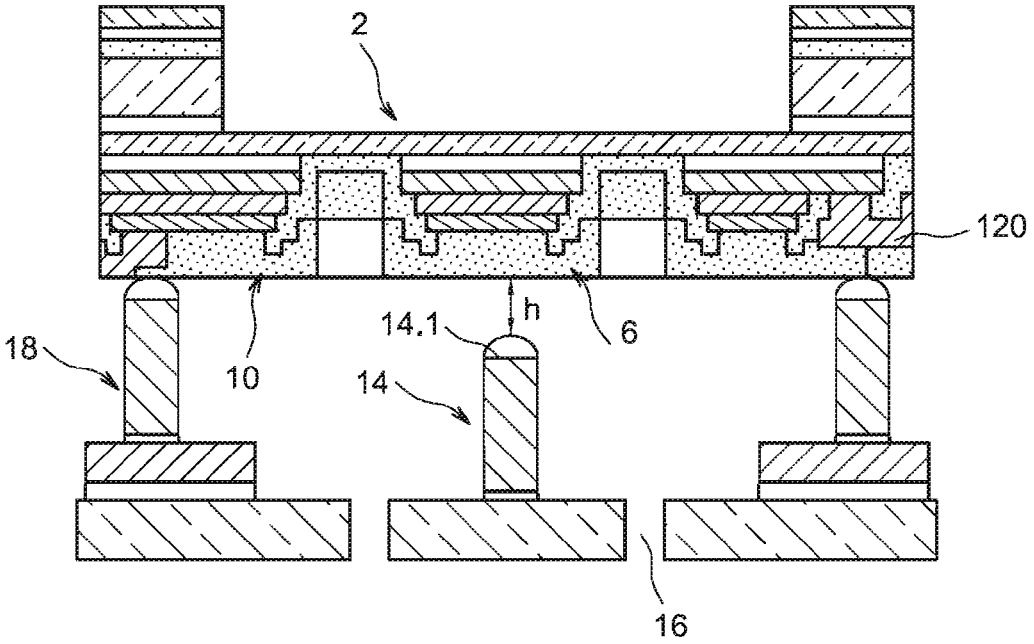

Then, the diaphragm 2 and the actuators 6, 10 shown in FIG. 5R and the substrate fitted with the electric connections and the stop member 14 of FIG. 6C are assembled. The electric connections 18 are aligned with the contact pads, and then contacted with the contact pads. Assembling is for example made by thermocompression. The loudspeaker is shown in FIG. 6D. In practice, the dry film is removed after assembling both substrates.

In this example, the height of the stop member is identical to the one of the electric connections, however the stop member being directly made on the substrate 200, its free end 14.1 does not contact the diaphragm at rest. The distance between the free end 14.1 and the diaphragm referred to as h is thus determined in this exemplary embodiment by the thickness of the portions of the connection lines. In order to determine h, the diaphragm carrying the actuators is considered. In FIG. 6D, h is the distance between the free end 14.1 and the actuator 6. In the case of a loudspeaker comprising another type of actuator, the latter would not necessarily be taken into account in calculating the distance h.

The distance h between the free end 14.1 of the stop member and the diaphragm is chosen so as to be lower than the theoretical maximum stroke of the diaphragm, preferably h is comprised between 50% of the theoretical maximum stroke and 75% of the theoretical maximum stroke of the diaphragm. The maximum deformation of the diaphragm is determined from the dimensions of the diaphragm.

In an exemplary embodiment in which only one actuator is used, the method for creating the stop members and the connection(s) is similar to the one described above.

Figure 7:
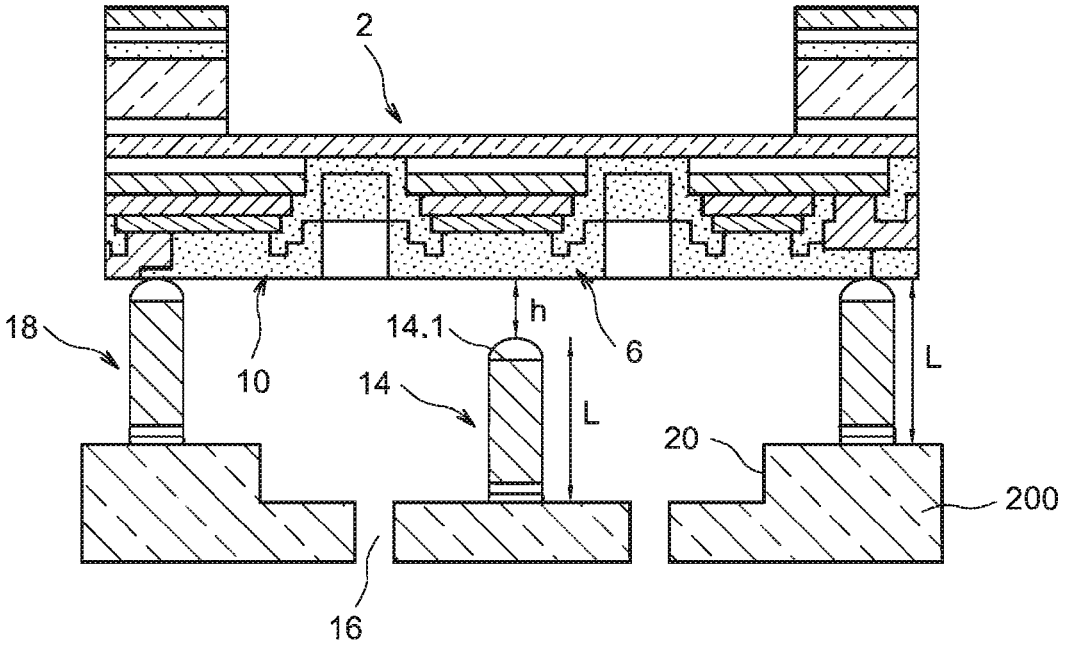
FIG. 7 is a diagrammatic view of an alternative method of FIGS. 6A to 6D, FIGS. 8A to 8C are diagrammatic views of steps for creating a support fitted with stop means of the invention according to another exemplary embodiment.

In FIG. 7, an alternative embodiment of the stop members can be seen, in the case where the control electronics is made on the substrate 200. In this case, the copper traces are not required to set the height h of the stop members but only to route the signal up to pads or to the electronics. The electric connections can be directly made on the substrate by depositing a Ti/Cu layer and a thick copper growth. The distance h between the free end 14.1 of the stop member and the diaphragm is then obtained by creating a recess 20 in the electronic substrate 200 at the future location of the stop member(s) prior to making the electric connections and the stop member. This recess has a depth h. This recess is for example made by partially etching of the electronic substrate 200. The stop member has the same height as the microbumps but, due to the presence of the recess having a depth h, the free end 14.1 of the substrate is at a distance h of the diaphragm at rest.

Figure 8A:
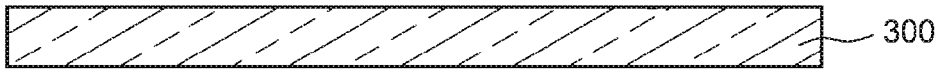
Figure 8B:
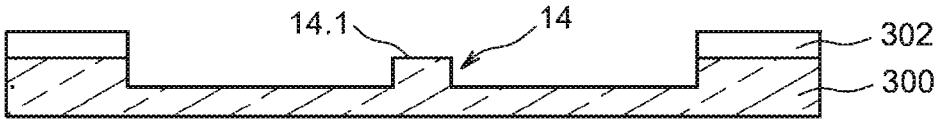
Figure 8C:
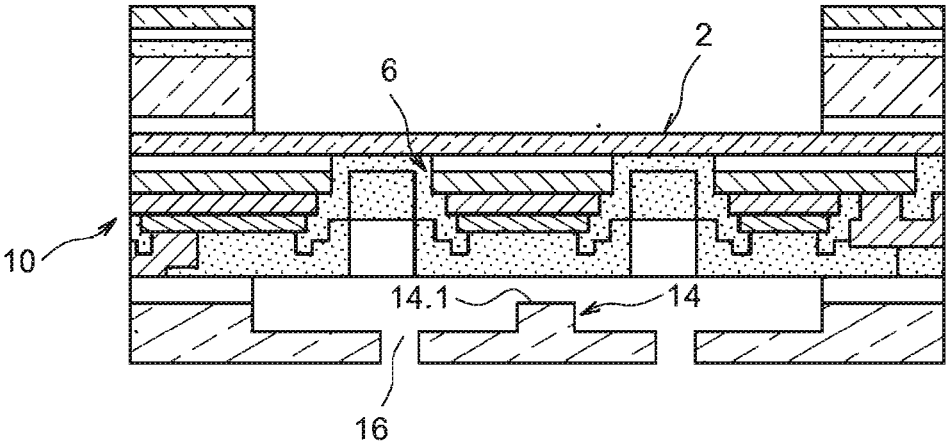

In FIGS. 8A to 8C, another exemplary embodiment of the stop members can be seen. In this case, the substrate is of the "packaging"-type, i.e. the function of the substrate is to overlap the diaphragm in order to package it.

Let us take for example substrate 300 of silicon (FIG. 8A).

Then, a layer 302 for the sealing with the diaphragm is formed; it is for example a gold or oxide layer.

The sealing layer is then etched in order to leave this layer only on the periphery of the substrate. The substrate is then structured, for example by partially etching, in order to create the stop member 14. The depth of the etching is chosen so as to obtain the desired distance h between the free end 14.1 of the stop member and the diaphragm. The depth of the etching takes into account the thickness induced by the assembly, for example by gold-gold gluing or molecular gluing. A thickness of the sealing layer has to be taken into account.

The member thus obtained is shown in FIG. 8B. The stop member is integral with the "packaging"-type substrate.

This member is then sealed with the diaphragm of FIG. 5Q, for example by gold-gold gluing, by molecular assembly (FIG. 8C).

It should be noted that the stop member could be made on the "packaging"-type substrate by inserting material as in the example of FIG. 7. Conversely, it could be considered, in the case of a interposer substrate, to make a stop member or stop members integral with the interposer substrate.

Figure 9:
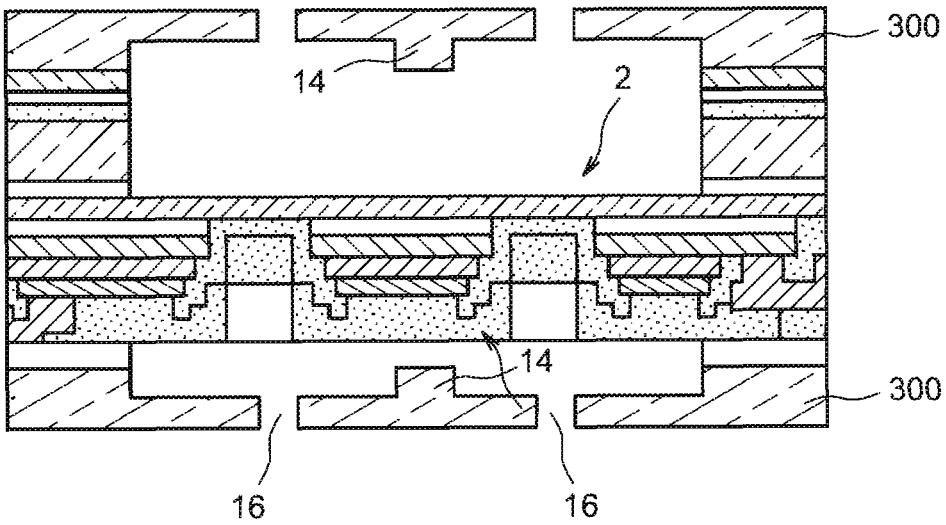
FIG. 9 is a diagrammatic view of a loudspeaker comprising stop means facing each of the diaphragm faces.

In FIG. 9, an alternative embodiment can be seen in which the loudspeaker comprises stop members of the diaphragm facing its two faces. This embodiment is particularly suited to the speaklet of FIGS. 1A to 1C which comprises two actuators able to move the diaphragm upwards and downwards in the view of FIG. 8C. As indicated above, actuating the diaphragm in both directions enables the sound to be reproduced more finely.

The loudspeaker of FIG. 9 is for example made as described in relation with FIGS. 8A and 8B, but it is not limiting.

Then, a second substrate such as the one of FIG. 8B is made.

The substrate supporting the diaphragm is then thinned so as to make its thickness lower than a maximum stroke of the diaphragm. It is possible to totally suppress the supporting substrate.

Then, the substrate 300 is assembled facing the face of the diaphragm opposite the one carrying the actuators.

In the example shown, the stop members 14 on either side of the diaphragm 2 have the same height but they could have different heights, for example as a function of the thinning level of the supporting substrate of the diaphragm.

Furthermore, it could be provided to assemble on the sub-assembly of FIG. 6C and to assemble a substrate of FIG. 8B.

In the embodiment where the stop members would be carried by the diaphragm, their creation would be for example obtained by depositing material after the step shown in FIG. 5P or the one shown in FIG. 5Q. For example, the stop members would be made by keeping part of the original substrate 100. The substrate would then be thinned to the desired thickness of the stop members, then the diaphragm would be released by etching the substrate, it could then be provided to leave the stop members.

The digital acoustic device according to the invention provides an increased sound power with a relatively simple structure. Furthermore, the creation method is hardly complexified relative to the creation of prior art digital acoustic devices, in particular in the case of the creation of microbumps.

It is particularly suited for making digital loudspeakers comprising a plurality of speaklets.

The invention claimed is:

1. A digital acoustic device comprising:

at least one suspended diaphragm facing a support;

at least one actuator associated with the diaphragm; the associated actuator being configured to move the diaphragm away from and/or closer to the support; and at least one stopper configured to interrupt movement of the diaphragm further to activating the actuator, when the diaphragm has a non-zero speed, the stopper being sized to interrupt the movement of the diaphragm at a contact point that is in a fixed position independent of the movement of the diaphragm, during reproduction of an audible sound of a desired sound level, when the movement of the diaphragm is greater than or equal to 50% of the theoretical maximum stroke of the diaphragm and lower than or equal to 75% of the theoretical maximum stroke of the diaphragm.

2. The digital acoustic device according to claim 1, wherein the stopper is sized to interrupt the movement of the diaphragm when the movement of the diaphragm is between 50% and 60% the theoretical maximum stroke of the diaphragm.

3. The digital acoustic device according to claim 1, wherein the stopper is sized to interrupt the movement of the diaphragm when the diaphragm moves at its maximum speed or at a speed close to its maximum speed.

4. The digital acoustic device according to claim 1, wherein the stopper comprises at least one stop member protruding from the support towards the diaphragm and/or protruding from the diaphragm towards the support, and having a free end separated by a non-zero distance from the diaphragm and/or the support at rest, respectively.

5. The digital acoustic device according to claim 4, wherein the stop member is located facing a central area of the diaphragm or is fixed in a central area of the diaphragm.

6. The digital acoustic device according to claim 4, wherein the distance separating the free end from the stop member and the diaphragm or the free end from the stop member and the support is between 50% and 75% of the theoretical maximum stroke of the diaphragm.

7. The digital acoustic device according to claim 1, wherein the stopper comprises a plurality of stop members protruding from the support towards the diaphragm and/or protruding from the diaphragm towards the support, and having a free end separated by a non-zero distance from the diaphragm and/or the support at rest, respectively.

8. The digital acoustic device according to claim 7, wherein the stop members are distributed on an area corresponding to a surface representing between 10% and 50% of the diaphragm surface.

9. The digital acoustic device according to claim 4, wherein the at least one stop member is in a shape of a column with a circular, square, ellipsoidal, or trapezoidal cross-section.

10. The digital acoustic device according to claim 4, wherein the at least one stop member is integral with the support and/or the diaphragm.

11. The digital acoustic device according to claim 4, wherein the at least one stop member is formed by one or more layers of materials inserted on a substrate and/or the diaphragm.

12. The digital acoustic device according to claim 4, wherein the actuator is carried by the diaphragm and is facing the free end of the at least one stop member, the device further comprising a protective layer deposited on the actuator to protect the actuator from contact with the free end of the at least one stop member.

13. The digital acoustic device according to claim 1, further comprising:

a gaseous fluid between the diaphragm and the support; and at least one passageway in the support for flow of the gaseous fluid to reduce viscous damping.

14. The digital acoustic device according to claim 13, wherein the stopper comprises a plurality of stop members protruding from the support towards the diaphragm and/or protruding from the diaphragm towards the support, and having a free end separated by a non-zero distance from the diaphragm and/or the support at rest, respectively, the passageway being formed between two stop members.

15. The digital acoustic device according to claim 1, wherein the at least one actuator is formed by a piezoelectric actuator.

16. The digital acoustic device according to claim 1, further comprising a first actuator in contact with the diaphragm configured to exert a strain on the diaphragm along a first direction, and a second actuator in contact with the diaphragm configured to exert a strain on the diaphragm along a second direction opposite to the first direction.

17. The digital acoustic device according to claim 16, wherein the first and second actuators comprise a ferroelectric piezoelectric material, each of the first and second actuators being configured to deform the diaphragm in an opposite direction.

18. The digital acoustic device according to claim 16, wherein the first actuator bounds an outer periphery of the diaphragm and the second actuator is substantially located in a central area of the diaphragm.

19. The digital acoustic device according to claim 16, further comprising a second support facing the diaphragm opposite to the first support, the second support comprising further stop means configured to interrupt movement of the diaphragm further to activating the second actuator.

20. The digital acoustic device according to claim 1, comprising a plurality of diaphragms and actuators associated with each of the diaphragms.

21. The digital acoustic device according to claim 1, forming a digital loudspeaker.

* * * * *